US006279957B1

(12) United States Patent
Capstran

(10) Patent No.: US 6,279,957 B1
(45) Date of Patent: Aug. 28, 2001

(54) ELASTIC BOOKMARK

(76) Inventor: Richard E. Capstran, 1741 Alta Vista Ave., Milwaukee, WI (US) 53213

( * ) Notice: Subject to any disclaimer, the term of this patent is extended or adjusted under 35 U.S.C. 154(b) by 0 days.

(21) Appl. No.: 09/766,440

(22) Filed: Jan. 19, 2001

(51) Int. Cl.[7] ..... B42D 9/00
(52) U.S. Cl. ..... 281/42
(58) Field of Search ..... 281/42, 45, 15.1, 281/20, 36, 37, 51; 40/658, 659; 24/67 K, 67.3; 116/239

(56) References Cited

U.S. PATENT DOCUMENTS 2,989,023 6/1961 Ellingsen ..... 116/119
4,162,800 * 7/1979 Conot, Jr. et al. ..... 281/42
4,778,201 * 10/1988 Kouno et al. ..... 281/42
5,054,816 * 10/1991 Rosengarten ..... 281/42
5,462,007 * 10/1995 Prescott ..... 281/42 X

* cited by examiner

*Primary Examiner*—Willmon Fridie, Jr.
(74) *Attorney, Agent, or Firm*—Donald J. Ersler

(57) ABSTRACT

An elastic bookmark includes a retention member and an elastic member. The retention member includes a base member, a first attachment arm, and a second attachment arm. Preferably, the first attachment arm is formed over a first end of the base member and the second attachment arm is formed over a second end of the base member. One end of the elastic member is attached to the first attachment arm and the other end of the elastic member is attached to the second attachment arm. A second embodiment of the elastic member includes a plate retainer attached to an elastic strap. A third embodiment of the elastic bookmark includes an elastic strap inserted through a tube retainer.

10 Claims, 2 Drawing Sheets

ELASTIC BOOKMARK

BACKGROUND OF THE INVENTION

1. Field of the Invention

The present invention relates generally to bookmarks and more specifically to an elastic bookmark which retains the last page read; even if the book is dropped or the reader falls asleep.

2. Discussion of the Prior Art

There are numerous bookmarks which have been patented. However, there at least two bookmarks which use an elastic member to retain the last page read. U.S. Pat. No. 2,989,023 to Ellingsen discloses a Book Mark Page Holder Device and U.S. Pat. No. 4,162,800 to Gonot, Jr. et al. discloses a Combination Bookmark And Writing Instrument Holder.

Accordingly, there is a clearly felt need in the art for an elastic bookmark which may be easily attached to a book cover and which retains the last page read.

SUMMARY OF THE INVENTION

The present invention provides an elastic bookmark which retains the last page read. The elastic bookmark includes a retention member and an elastic member. The retention member includes a base member, a first attachment arm, and a second attachment arm. Preferably, the first attachment arm is formed over a first end of the base member and the second attachment arm is formed over a second end of the base member. Preferably, the distance between the first end of the base member and the first attachment arm snugly receives a book cover. Preferably, the distance between the second end of the base member and the second attachment arm snugly receives the book cover. One end of the elastic member is attached to the first attachment arm and the other end of the elastic member is attached to the second attachment arm. To mark a page, the reader stretches the elastic member over the desired page. A second embodiment of the elastic member includes a plate retainer attached to an elastic strap. A third embodiment of the elastic member includes an elastic strap inserted through a tube retainer.

Accordingly, it is an object of the present invention to provide an elastic bookmark which may be easily attached to a book cover.

Finally, it is another object of the present invention to provide an elastic bookmark which always retains the last page read even if the reader falls asleep or drops the book.

These and additional objects, advantages, features and benefits of the present invention will become apparent from the following specification.

DETAILED DESCRIPTION OF THE PREFERRED EMBODIMENTS

Figure 1:
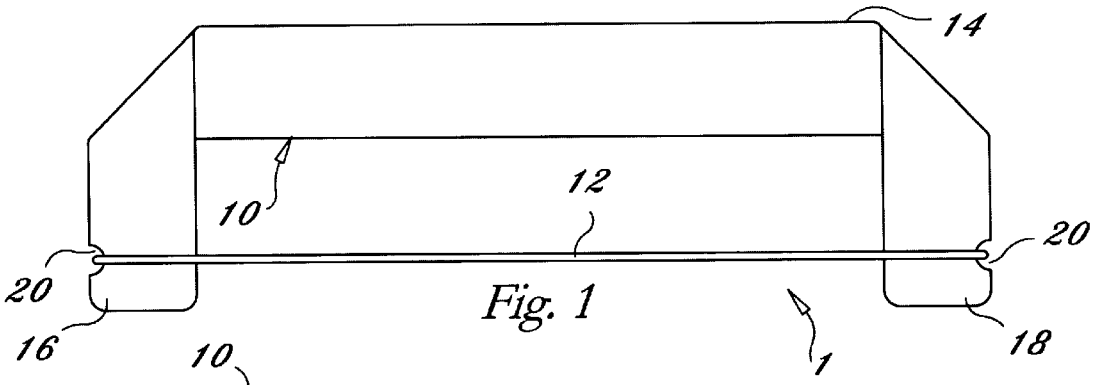
FIG. 1 is a top view of an elastic bookmark in accordance with the present invention.
Figure 2:
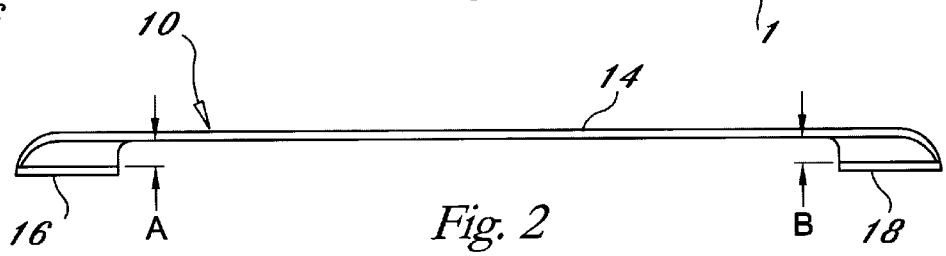
FIG. 2 is an end view of a retention member of an elastic bookmark in accordance with the present invention.
Figure 3:
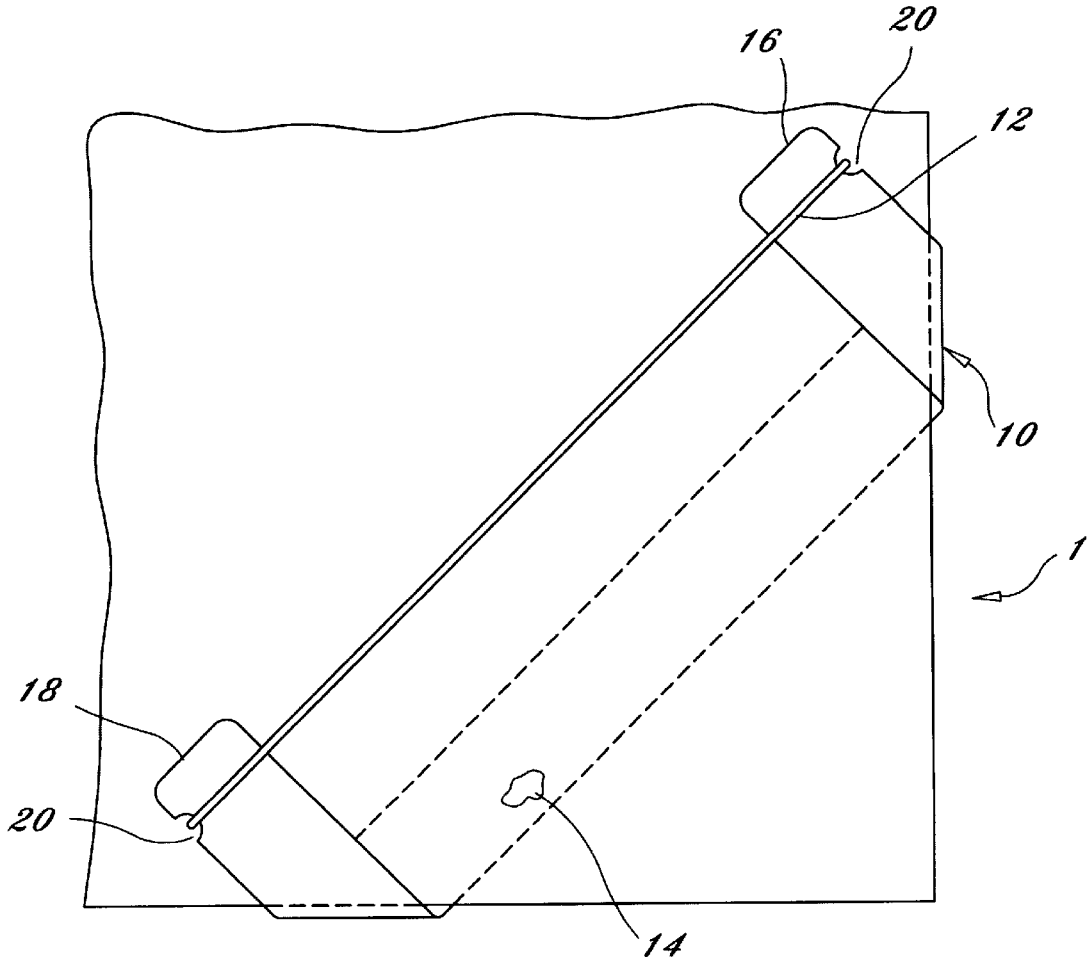
FIG. 3 is a top view of an elastic bookmark attached to a book in accordance with the present invention.
Figure 5:
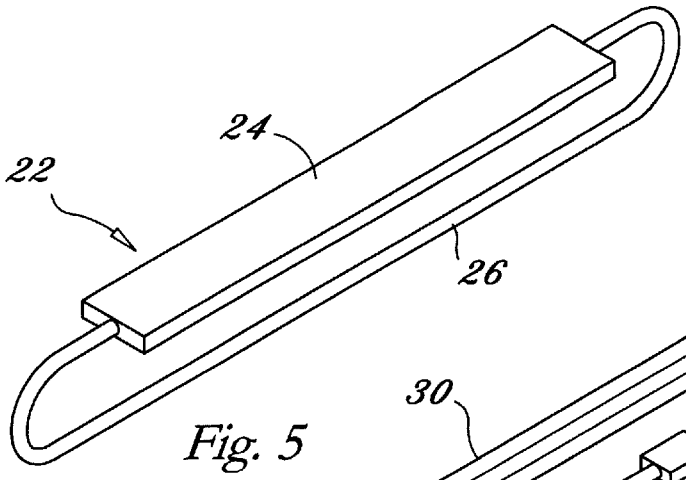
FIG. 5 is a perspective view of a second embodiment of an elastic member of an elastic bookmark in accordance with the present invention.
Figure 6:
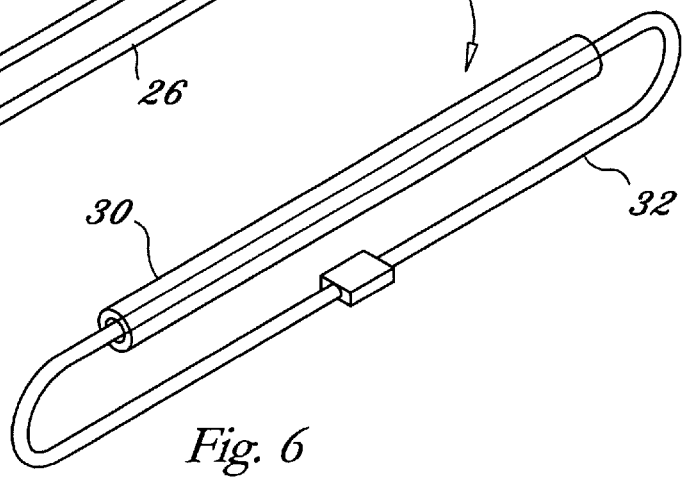
FIG. 6 is a perspective view of a third embodiment of an elastic member of an elastic bookmark in accordance with the present invention.
Figure 4:
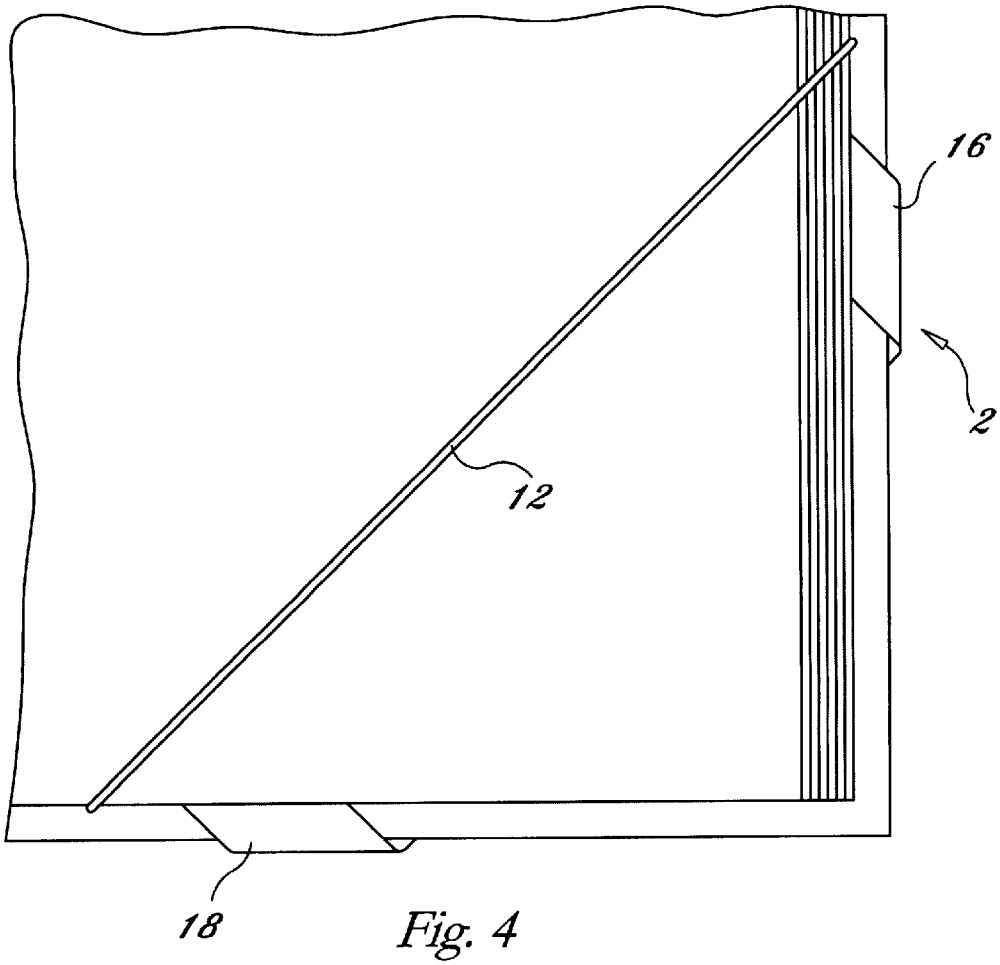
FIG. 4 is a top view of an elastic member of an elastic bookmark stretched over a page of a book in accordance with the present invention.

With reference now to the drawings, and particularly to FIG. 1, there is shown a top view of an elastic bookmark 1. With reference to FIGS. 2 and 3, an elastic bookmark 1 includes a retention member 10 and an elastic member 12. The retention member 10 includes a base member 14, a first attachment arm 16, and a second attachment arm 18. The retention member 10, first attachment arm 16, and second attachment arm 18 are preferably fabricated from a single piece of material. The first attachment arm 16 is formed over a first end of the base member 14, preferably perpendicular to a length of the base member 14 and the second attachment arm 18 is formed over a second end of the base member 14, preferably perpendicular to a length of the base member 14.

Preferably, the distance "A" between the first end of the base member 14 and the first attachment arm 16 is such that it snugly receives a book cover and the distance "B" between the second end of the base member 14 and the second attachment arm 18 is such that it snugly receives the book cover. The retention member 10 could also be fabricated from a material with memory such that no gap "A" exists between the first end of the base member 14 and the first attachment arm 16, and no gap "B" exists between the second end of the base member 12 and the second attachment arm 18. An example of a material with memory is Delrin plastic or spring steel. A notch 20 is preferably formed in the first and second attachment arms to receive and retain the elastic member 12, but other methods may also be used to retain the elastic member 12. The elastic member 12 is preferably a continuous loop, but could be a length of elastic material attached to the first and second attachment arms.

The elastic bookmark 1 is preferably used by pushing the retention member 10 on to the rear cover of the book. The elastic member 12 is stretched over the first page to be read. As the reader finishes with a page, it is slipped out from under the elastic member 12. If the reader falls asleep or drops the book, the elastic member 12 will still be stretched across the page that was last read.

A second embodiment of the elastic member 22 includes a plate retainer 24 and an elastic strap 26. The plate retainer 24 is preferably fabricated from a clear material. One end of the elastic strap 26 is attached to one end of the plate retainer 24 and the other end of the elastic strap 26 is attached to the other end of the plate retainer. The elastic strap 26 is retained preferably in the notches 20 formed in the first and second attachment arms. The plate retainer 24 does not obscure the words on the page as the elastic member 12 would.

A third embodiment of the elastic member 28 includes a tube retainer 30 and an elastic strap 32. The tube retainer 30 is preferably fabricated from a clear material. The tube retainer 30 may be slipped over the elastic strap 32 and the elastic strap cinched end to end with any suitable method or a slit formed in the tube retainer 30 and the tube retainer 30 snapped over the elastic strap 32. The ends of the elastic strap 32 may also be attached to the first and second attachment arms. The elastic strap 32 is retained preferably in the notches 20 formed in the first and second attachment arms. The tube retainer 30 will rotate about the elastic strap 32 as the page is pulled out from under thereof.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An elastic bookmark comprising:

a retention member having a base member, said base member having a first end and a second end, said first end of said base member being bent over itself to form a first attachment arm, said second end of said base member being bent over itself to form a second attachment arm; and an elastic member being retained by said first and second attachment arms.

2. The elastic bookmark of claim 1 wherein:

a first notch being formed in said first attachment arm and a second notch being formed in said second attachment arm, said elastic member being retained by said first and second notches.

3. The elastic bookmark of claim 1, further comprising:

said elastic member being a continuous loop.

4. The elastic bookmark of claim 1, further comprising:

said elastic member including a plate retainer and an elastic strap, one end of said elastic strap being attached to one end of said plate retainer and the other end of said elastic strap being attached to the other end of said plate retainer, said plate retainer being fabricated from a clear material.

5. The elastic bookmark of claim 1, further comprising:

said elastic member including a tube retainer and an elastic strap, said tube retainer being retained by said elastic member, said tube retainer being fabricated from a clear material.

6. An elastic bookmark comprising:

a retention member having a base member, a first attachment arm and a second attachment arm, said first attachment arm being formed over a first end of said base member and a second attachment arm being formed over a second end of said base member; and an elastic member being retained by said first and second attachment arms, said elastic member including a plate retainer and an elastic strap, one end of said elastic strap being attached to one end of said plate retainer and the other end of said elastic strap being attached to the other end of said plate retainer, said plate retainer being fabricated from a clear material.

7. The elastic bookmark of claim 1 wherein:

a first notch being formed in said first attachment arm and a second notch being formed in said second attachment arm, said elastic member being retained by said first and second notches.

8. An elastic bookmark comprising:

a retention member having a base member, a first attachment arm and a second attachment arm, said first attachment arm being formed over a first end of said base member and a second attachment arm being formed over a second end of said base member; and an elastic member being retained by said first and second attachment arms, said elastic member including a tube retainer and an elastic strap, said tube retainer being retained by said elastic member, said tube retainer being fabricated from a clear material.

9. The elastic bookmark of claim 8 wherein:

a first notch being formed in said first attachment arm and a second notch being formed in said second attachment arm, said elastic member being retained by said first and second notches.

10. The elastic bookmark of claim 1 wherein:

said first attachment arm being substantially perpendicular to said base member and said second attachment arm being substantially perpendicular to said base member.

* * * * *